US007614498B2

(12) United States Patent
O'Keefe

(10) Patent No.: US 7,614,498 B2
(45) Date of Patent: Nov. 10, 2009

(54) DISTRESSED PACKAGING WITH EXTENDED VISUAL ELEMENT

(75) Inventor: Bill O'Keefe, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 469 days.

(21) Appl. No.: 11/429,130

(22) Filed: May 4, 2006

(65) Prior Publication Data

US 2007/0256951 A1 Nov. 8, 2007

(51) Int. Cl.
*B65D 85/00* (2006.01)

(52) U.S. Cl. ..... 206/459.5; 206/469; 206/471; 206/806

(58) Field of Classification Search ..... 206/457, 206/458, 461, 471, 459.1, 458.5, 807, 469, 206/806, 459.5
See application file for complete search history.

(56) References Cited

U.S. PATENT DOCUMENTS

| | | | | |
|---|---|---|---|---|
| D71,588 | S | 12/1926 | Jester | |
| 2,212,397 | A * | 8/1940 | Gomes et al. | 434/100 |
| D167,914 | S | 10/1952 | Taranton | |
| D262,652 | S | 1/1982 | Jaeschke et al. | |
| D274,604 | S | 7/1984 | Jeruchim | |
| 4,485,920 | A * | 12/1984 | Skylvik | 206/468 |
| 4,781,289 | A * | 11/1988 | Perkins | 206/45.24 |
| D299,319 | S | 1/1989 | Durand | |
| 4,901,858 | A * | 2/1990 | Anderson | 206/461 |
| 4,905,828 | A * | 3/1990 | Dods | 206/335 |
| 4,945,708 | A | 8/1990 | Curiel | |
| 5,137,208 | A | 8/1992 | Wang et al. | |
| D335,455 | S | 5/1993 | Brown | |
| D335,456 | S | 5/1993 | Brown | |
| D338,824 | S | 8/1993 | Chen | |
| 5,582,293 | A * | 12/1996 | Kay | 206/457 |
| 5,758,777 | A * | 6/1998 | Dods | 206/776 |
| 5,908,111 | A * | 6/1999 | Purdy | 206/461 |
| 6,070,724 | A * | 6/2000 | McCool | 206/352 |
| D429,166 | S | 8/2000 | Ogg | |
| 6,152,298 | A * | 11/2000 | Dods | 206/335 |
| 6,409,019 | B1 * | 6/2002 | Hornsby et al. | 206/471 |
| D501,362 | S | 2/2005 | Gauss | |
| D507,746 | S | 7/2005 | Sasaki et al. | |
| D509,729 | S | 9/2005 | Proudfit | |
| 7,021,466 | B2 * | 4/2006 | Kuske et al. | 206/494 |

* cited by examiner

*Primary Examiner*—Luan K Bui
*Assistant Examiner*—Chun Cheung
(74) *Attorney, Agent, or Firm*—Edell, Shapiro & Finnan LLC

(57) ABSTRACT

A package for a product includes an extended visual element having a first visual element section and a second visual element section. The first visual element section has a physically distressed edge region and the second visual element section has a graphically distressed region. A packaging portion includes the first visual element section and the second visual element section, where the physical distress and graphical distress are spatially adjacent, and where the physical distress and graphical distress are related to the product.

21 Claims, 12 Drawing Sheets

DISTRESSED PACKAGING WITH EXTENDED VISUAL ELEMENT

BACKGROUND AND SUMMARY

Various approaches may be used to enhance the visual impact of packaging. Such tactics may be particularly useful for products that are sold to consumers in stores with many alternative products, such as toys. As such, various types of graphics have been used on packaging to enhance visual impact. Likewise, various types of shape modifications have been used on packaging to enhance visual impact.

The inventors herein have recognized that by utilizing edge distressing and graphical distressing together, the visual impact of packaging distress can be enhanced, in particular where the distress relates to a feature of the product contained in the packaging.

The inventors herein have also recognized that while graphics or selected shaping of/physical modifications to packaging may be advantageous, by combining at least graphical elements and shaping features to generate at least one extended visual element in the packaging, it is possible to obtain further improved packaging differentiation and visual impact. In one particular example, an extended visual element on a toy package includes both physical distressing and graphical distressing elements that combine to provide an enhanced visual impact of packaging distress. Further, the toy may have animal-like features that relate to the distress. In this way, enhanced visual impact of the packaging can be achieved.

DETAILED DESCRIPTION

The accompanying figures and this description depict and describe embodiments of a packaging for a toy, in particular a packaging that exhibits a form of visual distress, where the distress may be related to the toy. The packaging may include a plurality of components. Further, the distress may include an extended visual element that may be graphically distressed and/or shape/physical distressed. Also, the extended visual element may extend across a plurality of sections of the packaging, and appear to be caused by a destructive act, for example. It should be appreciated that while this example relates to packaging for a toy, it could be applied, or may be more applicable to, various products other than toys. Further, while an extended visual element exhibits a form of distress related to the product, it may again be applied, or may be more applicable, to other effects, features, or visual elements that may or may not be related to the product.

Figure 1:
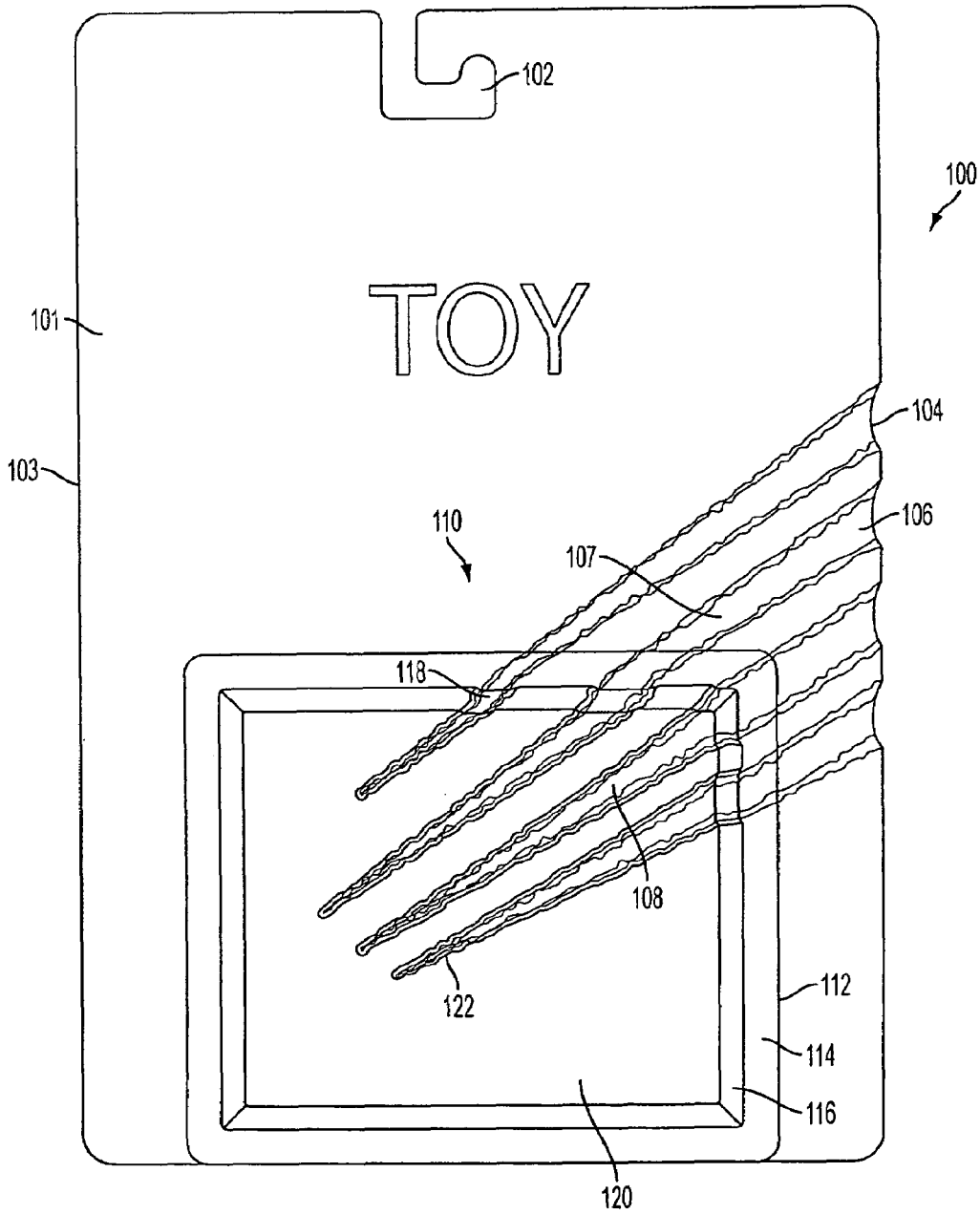
FIGS. 1-2 show a first example packaging.

One embodiment of the packaging 100 is shown in FIG. 1 as it might appear to a consumer at a retail store. For display purposes at a point of sale, the package 100 may be configured to stand on a shelf, hang from a rack or be stacked. In this embodiment, the packaging 100 may include a backer board 101 and a front panel 110 within which the product (not shown) in the packaging may be contained. While one or more of the above packaging components may be used, still other components may also be used. For example, the packaging 100 may be a blister package including a backer board 101 and a front panel 110. Unless specifically otherwise disclosed or taught, materials for making components of the present application may be selected from appropriate materials such as metal, metallic alloys, natural and manmade fibers, vinyls, plastics and the like, and appropriate manufacturing or production methods, including casting, thermoforming, pressing, extruding, molding and machining, may be used.

The backer board 101 is generally flat, and may be made from one or more pieces, sheets and/or layers of generally planar or flat suitable material, such as but not limited to plastic, cardboard, paper, or the like. Its surface may be capable of receiving or including a graphical design, instructions, a product description, a trademark, a bar code, or other indicia or printed material. The backer board 101 includes of a plurality of edges 103 that intersect or meet to give the board a geometric shape and a hanging aperture 102 located on or near one of the edges 103. While FIG. 1 shows backer board 101 having a generally rectangular and two-dimensional shape, various other shapes may be used. For example, it may be a three-dimensional shape that is substantially curved and round.

Continuing with FIG. 1, the front panel 110 includes an outward surface 120, side surfaces 116, and a rim area 112 adapted to engage the front panel 110 to the backer board 101. While FIG. 1 shows the front panel 110 as generally rectangular, it may be alternatively and/or irregularly shaped, such as to conform to the product (not shown) in the packaging. Various forms of suitable fastening, mounting, attaching or connecting device 114 or method may be used to couple or join the backer board 101 to the front panel 110 to form the package 100 as a whole and, unless specifically described otherwise, may encompass fasteners such as threaded connectors, snaps or snap fitting, clamps, rivets, pins and the like. Components may also be connected by adhesives, glues, heating, welding, ultrasonic welding, friction fitting or deformation, if appropriate.

In one embodiment the front panel 110 comprises a formable or moldable polymeric material that may be optically transparent, opaque, totally non-transparent, or exhibit some degree of transparency therebetween, or combinations thereof. The level of transparency may be consistent across the surface of the front panel 110 or it may be varied in spatial regions. For example, various portions of the front or side of panel 110 may be at least partially non-transparent, and may further have varying degrees of transparency across different sections. Transparent front panels may be desirable for embodiments used to package children's toys and the like because potential purchasers may view the product to be sold without opening the packaging 100. Opaque front panels may be desirable for embodiments used to store items that can be damaged by exposure to light, as well as toys in some examples. Combinations of transparent, opaque or non-transparent regions or areas may be used to enhance the display and/or protection of selected products, such as toys. In one example, a transparent front panel 110 may be used to display the product.

In one example process or method of making a package 100, the front panel 110 begins as a generally flat sheet of material, for example, a clear polymeric material. In this instance, this sheet of material is preheated in an oven to a temperature somewhat below its melting point. The preheated sheet is then removed from the oven, placed over a mold, and pulled or pushed against the mold's surface using vacuum, air, and/or mechanical pressure. Because the mold is usually at a relatively cool temperature, the polymeric sheet sets upon contact into a configuration that generally conforms to the shape of the mold. The cavity is then occupied by at least one product, such as a toy and/or the various products described herein. The product may be fed directly from the output end of a product producing machine, such as an injection molding machine, or from the output of any machine which produces products suitable for marketing in blister packs. While this is one example method, various other methods or modifications may also be used, such as combining or deleting various steps or actions.

Returning to FIG. 1, a plurality of visual elements of distress are depicted on the packaging 100 to generate extended visual elements, one of which is identified at 107. Visual element 107 may include at least a visual element 106 on the backer board 101, a visual element 108 on the front panel 110, and visual element 104, for example. Additional extended visual elements may also be included, for example the combination of visual element 106 and the edge distress 104, and/or the combination of visual element 106 and 108. There may be a theme to the plurality of visual elements, in particular the theme may be associated or related in some way to the product being displayed. For example, although not shown, the product in the packaging in this embodiment may be a monster truck that has animal-like qualities such as animal print exterior details and/or jaws on the front grill of the truck. The visual elements of distress may then include claw marks that relate to the monster truck with animal-like qualities, where the claw marks include at least.

The plurality of visual elements may be spatially coordinated and/or aligned. In one example, the plurality of visual elements may be coordinated and may optionally appear to extend through multiple sections of the packaging 100 continuously, thereby generating an exciting and visually stimulating packaging, at least to some customers of the product being sold. For example, at least two visual elements may be spatially adjacent one another and aligned so that the elements when viewed in combination may appear to be caused by a common distressing event. In another example, at least two visual elements may be spatially contiguous with one another and spatially aligned so that the elements when viewed in combination may appear to be caused by a common distressing event. In still another example, at least two visual elements may be spatially adjacent, aligned, and continuous so that it appears as though a common distressing event moved continuously across at least a portion of the packaging (which may include multiple sections of the packaging and/or different components of the packaging). Note, however, that while two elements may be spatially coupled, aligned, and/or continuous, it may be more advantageous to have the elements spatially de-coupled, un-aligned, and/or discontinuous, and/or optionally appearing to be caused by a common distressing event with or without motion.

It should be appreciated that various visual elements and modes of distress have been contemplated. For example, the visual element 106 on the backer board 101 may be graphically distressed, and the visual element 108 on the front panel 110 may be shape distressed. A graphically distressed visual element may include two-dimensional shading, marking, drawing, or other graphical distress. For example, in the example of FIG. 1, the visual element 107 may represent claw marks, where the visual element 106 may be drawn on the backer board 101. Further, the drawn claw marks may vary in width to simulate, for example, the beginning of the clawing starting at edge 103 shows wider drawn claw marks than a more interior portion of the drawn claw marks. Such variation enhances the perception that the graphics were generated via clawing motion over the packaging.

A shape distressed visual element may include changes in texture, cavities, ridges, holes, physical properties, or disruptions to surface of the packaging 100, for example. In this embodiment, the front panel 110 may exhibit ridges as visual element 108 that may be sunken beneath (or raised above) the outer surface 120 and/or the side surface 116 of the front panel 110. Further, the ridges may vary in depth and/or width to simulate, for example, the beginning of the clawing that may cause deeper and wider ridges (near the edge of panel 120) than the end of the motion (in the interior of panel 120) when the claw may be pulling away from the front panel 110 that may cause more shallow and/or narrower ridges at 122. The shape distress may be concave or convex in nature to the general surface of the front panel 110. Further, the shape distress may be a smooth or regularly shaped section in an otherwise rough or irregularly shaped packaging section, thereby interrupting the general surface shape. In another example, shape distress may include a disruption to the edge 103 of the backer board 101, such as the ridges 104 at the edge 103 of the backer board 101. Any portion of the packaging may exhibit graphic and/or shape distress or a combination thereof. Further, combinations of distress may be used to simulate a continuous distress extended across various sections of the packaging 100. Further still, combinations of distress may be used to simulate the effects of at least one common distressing event traversing at least a plurality of sections of the packaging 100, such as backer board 101 and front panel 110.

As shown by FIG. 1, the combination of graphical and shape distressed elements enables it to appear that at least a common distressing event or act has occurred across packaging 100. Further, the alignment, spatial positioning, and coordinated combination of graphics and shaping may generate a striking effect on the packaging, greater than shape distress or graphical distress alone.

Figure 2:
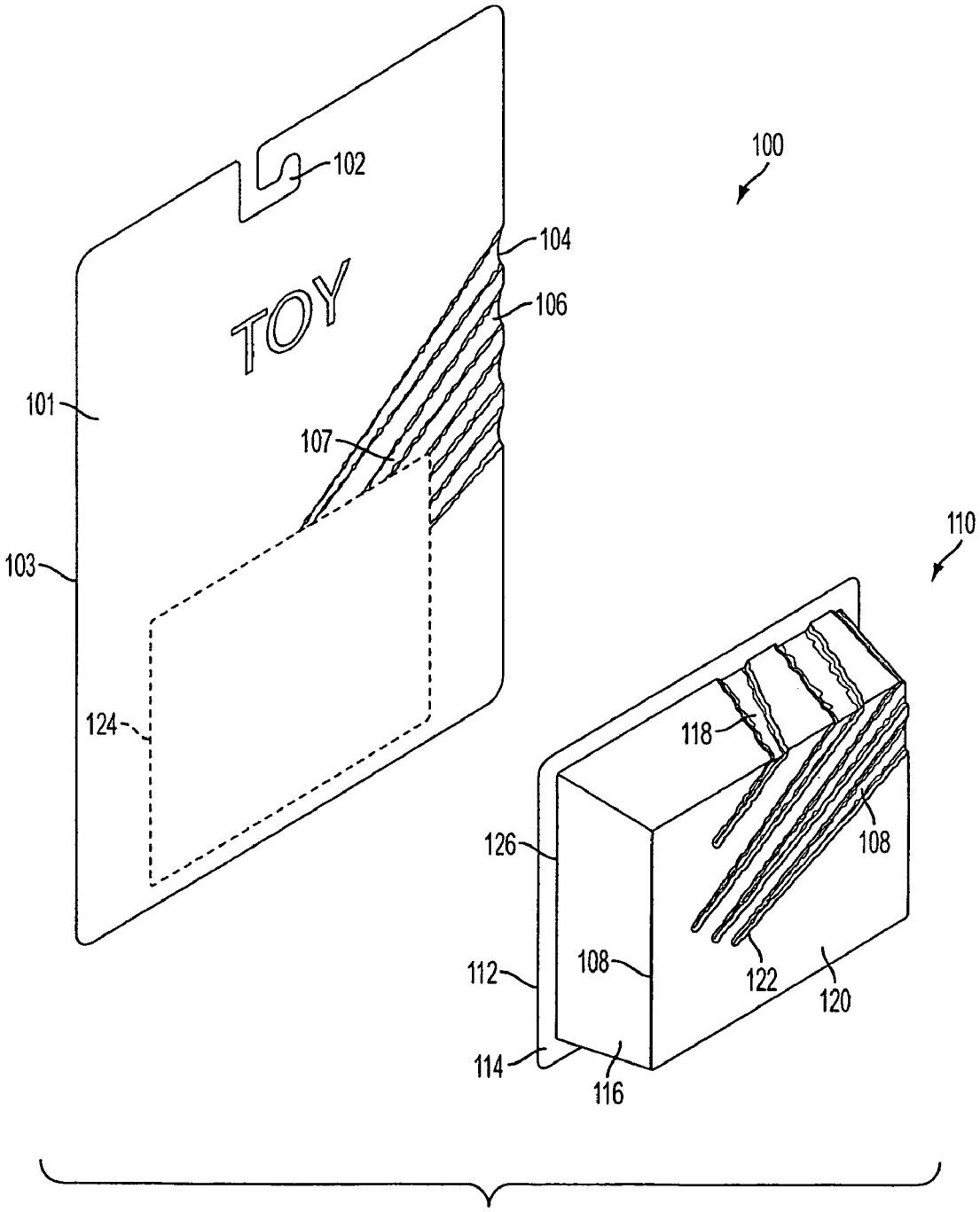

Referring now to FIG. 2, an exploded view of the packaging is shown with the backer board 101 separated from the front panel 110. The backer board 101 may be framed by a suitable adhesive material 114, such as an approximately one-quarter inch strip of glue or double-sided tape, and secured to the rim 112 of the front panel. The adhesive material may be selected to hold the rim 112 of the front panel 110 to the backer board 101 such that inner edge of the rim 126 is superimposed on the dashed line 124 of the backer board 101 and with sufficient force so that they will not separate during shipment and display. Other securing methods (e.g., methods appropriate for the package material, sonic welding, mechanical fasteners, etc.) may be used alone or in conjunction with an adhesive.

Continuing with FIG. 2, elements of distress may be extended across various sections of the packaging 100, in particular elements of distress may be extended from the edge 103 of the backer board 101 and/or across the backer board 101 and/or up the side surface 116 of the front panel 110 and/or across the outer surface 120 of the front panel 110. In this embodiment, the distressed edge 104 shows a plurality of curvatures that may depict the beginning of a claw mark and thereafter extend across the backer board 101 in a graphically distressed visual element 106. The distress further continues to extend up the side surface 116 of the front panel 120 in a shape and/or graphically distressed visual element, and across the outer surface 120 of the front panel 110. The distress on the side surface 116 of the front panel 110 and/or the outer surface 120 of the front panel 110 may be a shape distressed visual element 118, 108 where the texture or shape of the front panel 110 may be disrupted. Further, the distressed edge 104 and/or a graphically distressed visual element 106 and/or a shape distressed visual element 118, 108 may be coordinated to depict an extended distress, in particular an extended distress beginning at the distressed edge 104 and narrowing as the element continues across the backer board 101 to the outward side 120 of the front panel 110. The width of the distress may narrow across the entire extended element in one example.

Figure 3:
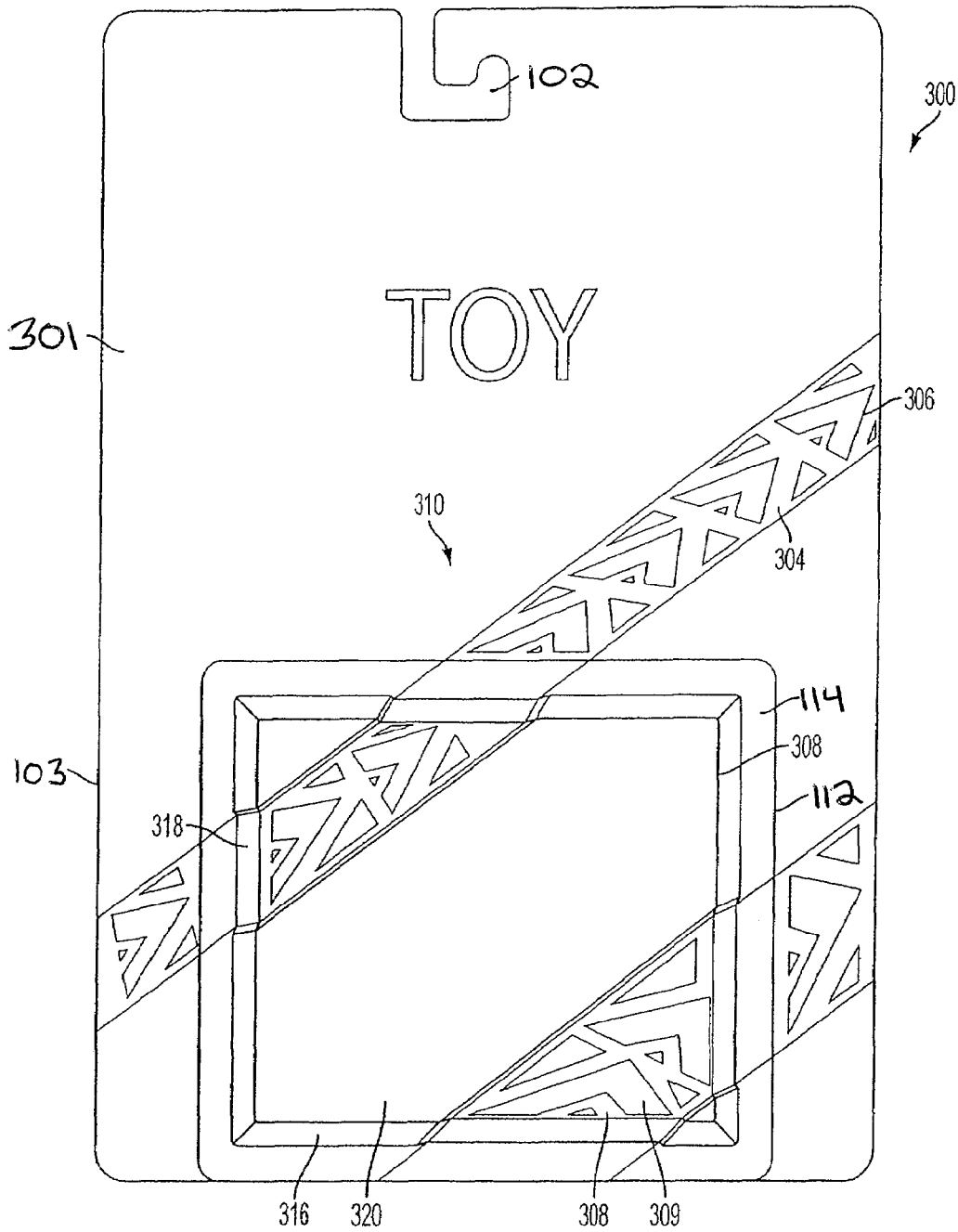
FIGS. 3-4 show a second example packaging.

Another embodiment of the packaging 300 is shown in FIG. 3. In this embodiment, the product being displayed may be a toy race car or toy armored vehicle, for example. The packaging 300 may include a backer board 301 and a front panel 310. The backer board 301 may be graphically distressed with drawings of tire tracks 304 where the tread 306 may be a different color or shading than the tire track 304. The front panel 310 may be shape distressed by tire imprints 308. In this example, the tire imprints 308 may be concave strips that traverse the outer surface 320 of the front panel 310 with tire tread 309 that may be convex to the tire imprints 308. The side surface 316 of the front panel 310 may be imprinted with tire imprints 318. The tire imprints 318 on the side surface 316 of the front panel 310 may be varied depths and widths. In this example, there are no tire tread 309 on the tire imprints 318 on the side surface 316 of the front panel 310, although in other embodiments there may be tire tread 309.

This example shows an extended distress across at least a plurality of sections of packaging 300 using at least shape and graphically distressed elements, where the distress appears to be caused by a vehicle driving over the packaging in a straight direction. However, the tracks can include one or more bends or turns, if desired. Further, while two tire tracks are shown, such as for a 4-wheeled vehicle, a single track may be shown, such as for a motorcycle. While the tracks are shown with substantially constant width and/or depth, one or both of these may be varied to simulated bounding motion of the vehicle as it drove over the package. Finally, while the two tracks are shown of a different width compared with one another, they may also have substantially equal track width.

Figure 5:
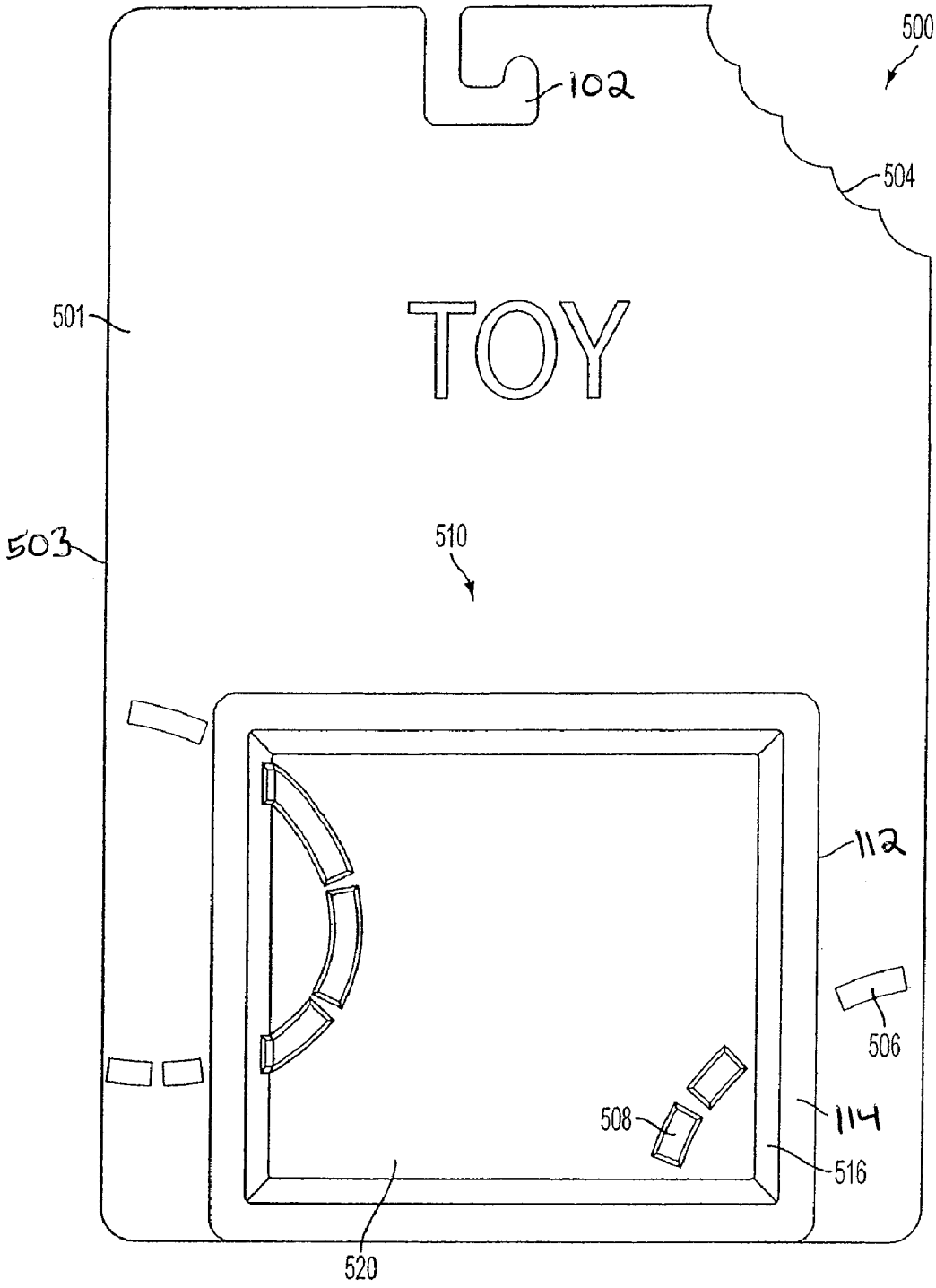
FIGS. 5-6 show a third example packaging.
Figure 6:
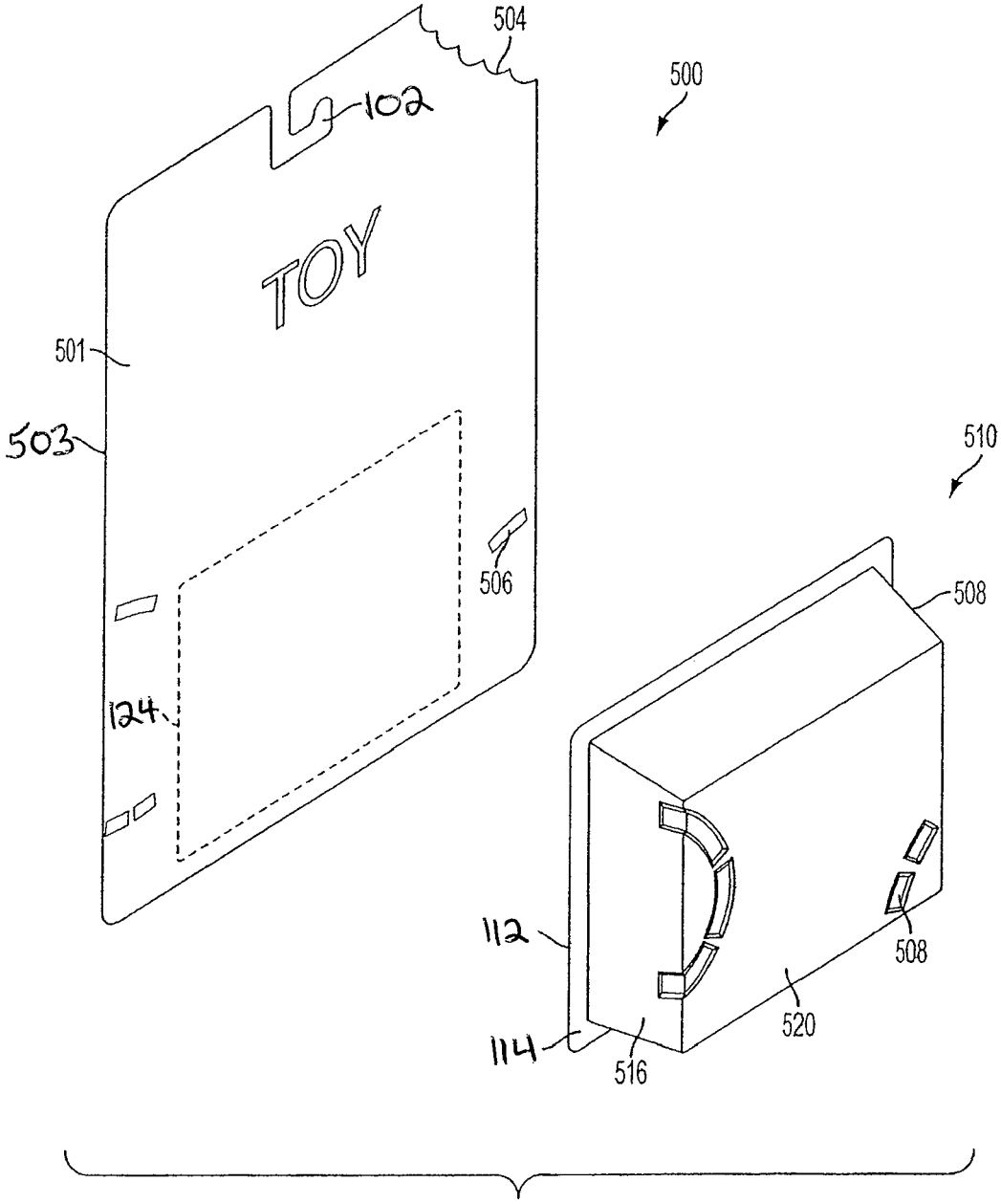

Yet another embodiment of the packaging 500 is shown in FIGS. 5-6. In this embodiment, the product being displayed may be a wind up jaw toy or a pair of fake teeth. The packaging 500 may include a backer board 501 and a front panel 510. The backer board 501 may be graphically distressed with drawings of teeth marks 506 where the teeth marks 506 may be a different color or shading than the rest of the backer board 501. Further, the edge 503 of the backer board 501 may be edge distressed by the outline of teeth 504. The outer surface 520 and/or side surface 516 of the front panel 510 may be shape distressed by teeth imprints 508.

This example shows an extended distress across at least a plurality of sections of packaging 500 using at least shape and graphically distressed elements, where the distress appears to be caused by a mouth bite. Specifically, two separate extended distresses are shown on the left and right side of the packaging, illustrating two separate bites, or distressing events. While the bites are apparently generated by regularly shaped teeth, the graphical and shape distresses may be modified to simulate irregular teeth, fangs, or the like. Also, rather than utilizing depressions in outer surface 520, for example, holes may also be used.

Figure 7:
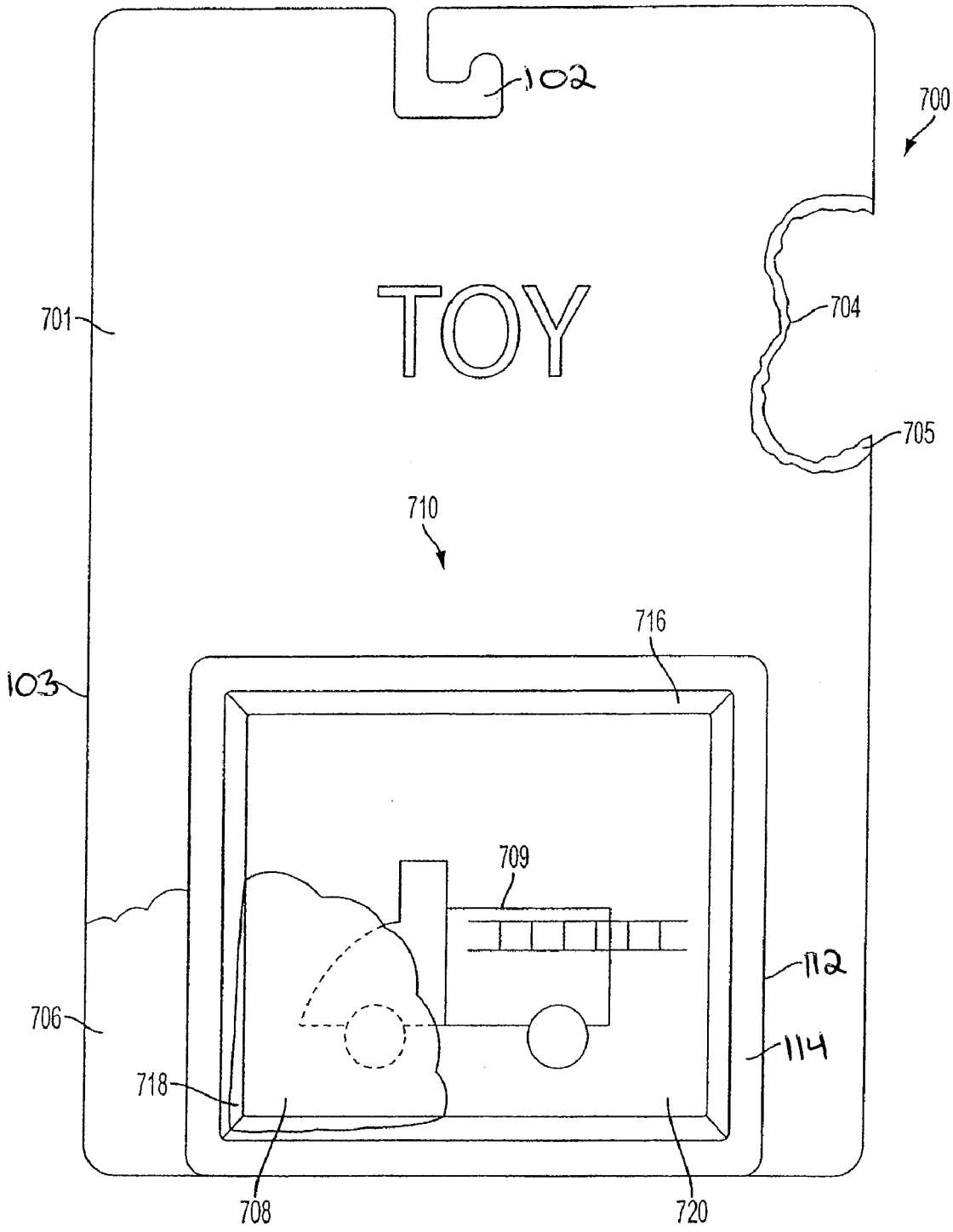
FIGS. 7-8 show a fourth example packaging.
Figure 8:
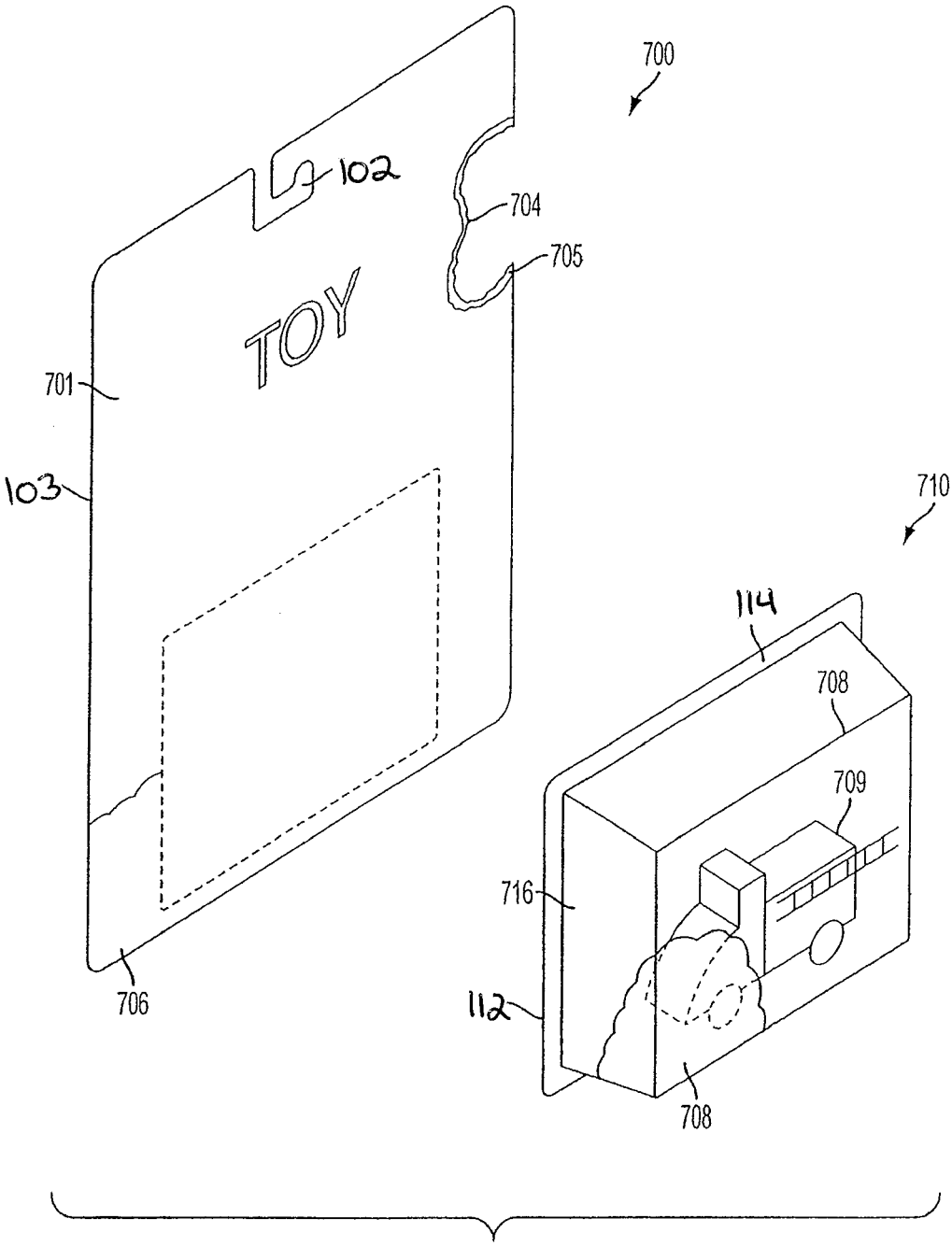

Still another embodiment of the packaging 700 is shown in FIGS. 7-8. In this embodiment, the product being displayed may be a toy fire truck or figurine fireman. The packaging 700 may include a backer board 701 and a front panel 710. The backer board 701 may be graphically distressed with grey or black coloring 706. Further, the backer board 701 may be edge distressed 704 by a burned edge as well as graphically distressed by a colored burn mark 705. The side surface 716 and/or the outer surface 720 of the front panel 710 may be physically distressed by a tint 718, 708 respectively where the coloring may be transparent, opaque, totally non-transparent, or exhibit some degree of transparency therebetween, or combinations thereof. Specifically, grey or black coloring 706 may include smoke effects, and tints 718, 708 may include smoked non-transparent physical distressing. Further still, the area of front panel 710 including 718, 708 may be shape warped to simulate the effects of applied heat and/or melting. Further, the outer surface 720 may include an image related to or of the product being displayed, e.g. an image of a toy fire truck 709.

This example shows an extended distress across at least a plurality of sections of packaging 700 using at least physical and graphically distressed elements, where the distress appears to be caused by fire or heat.

Figure 9:
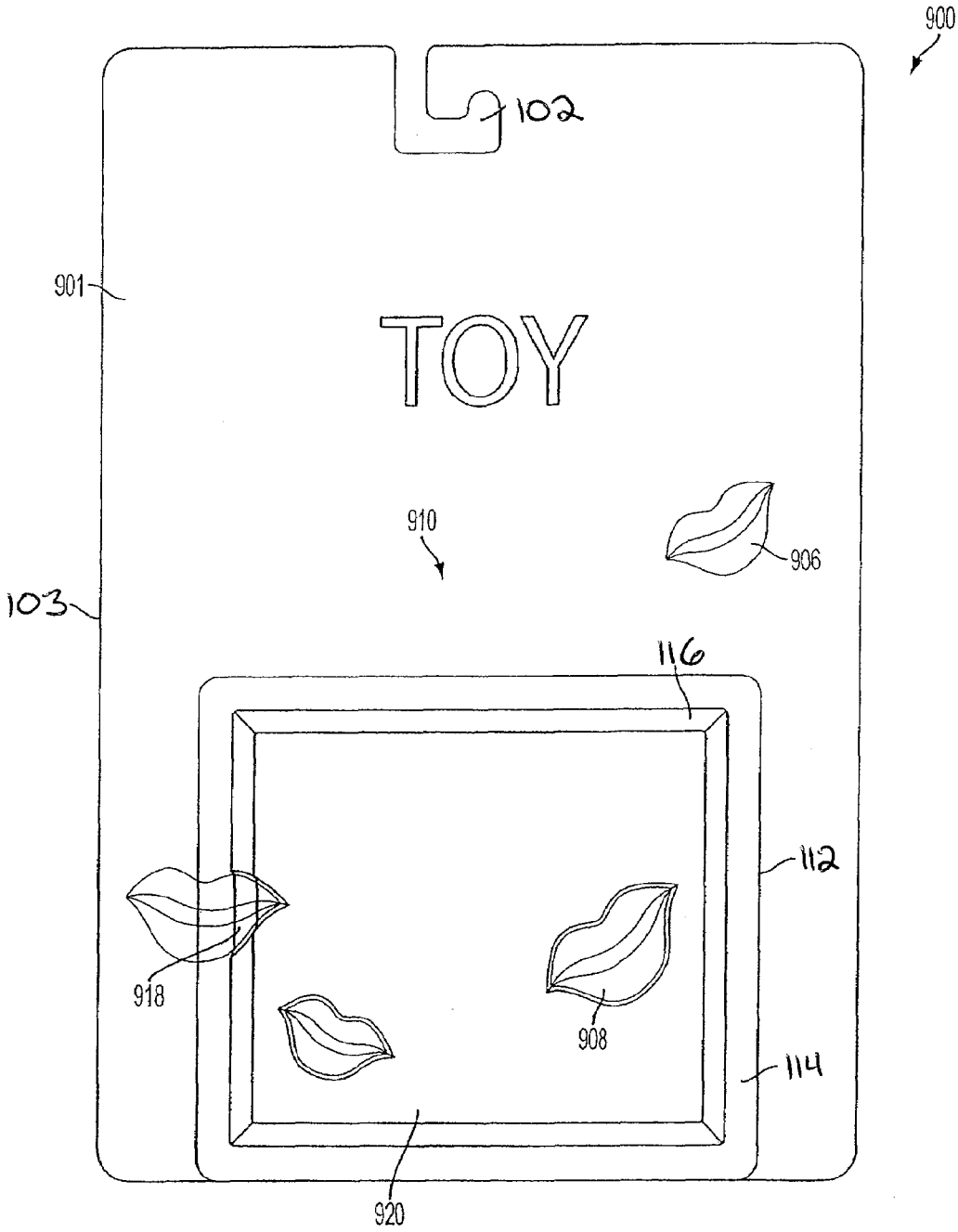
FIGS. 9-10 show a fifth example packaging.
Figure 10:
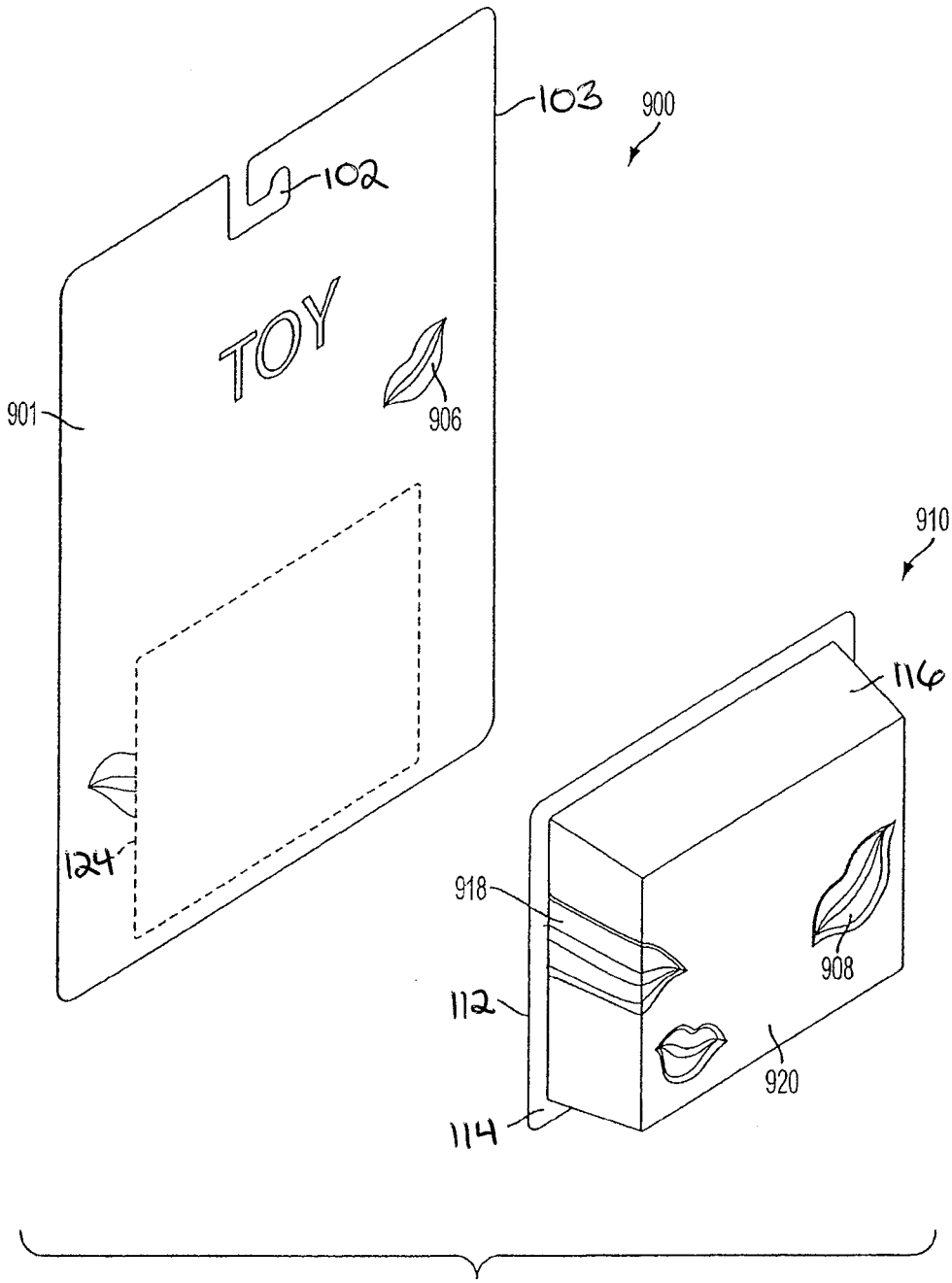

Even another embodiment of the packaging 900 is shown in FIGS. 9-10. In this embodiment, the product being displayed may be a doll, a lipstick toy, or lipstick. The packaging 900 may include a backer board 901 and a front panel 910. The backer board 901 may be graphically distressed with drawings of kiss marks 906 where the kiss marks 906 may be a different color or shading than the rest of the backer board 901. The outer surface 920 of the front panel 910 may be shape distressed by kiss imprints 908 and side surfaces 116 disrupted by shape distressed element 918, where the kiss imprints 908 and shaped distressed element 918 may be convex or concave to the general surface of the front panel 910. In another example, the kiss marks 908 and shaped distressed element 918 may exhibit a different texture than the general surface of the front panel 910.

Figure 11:
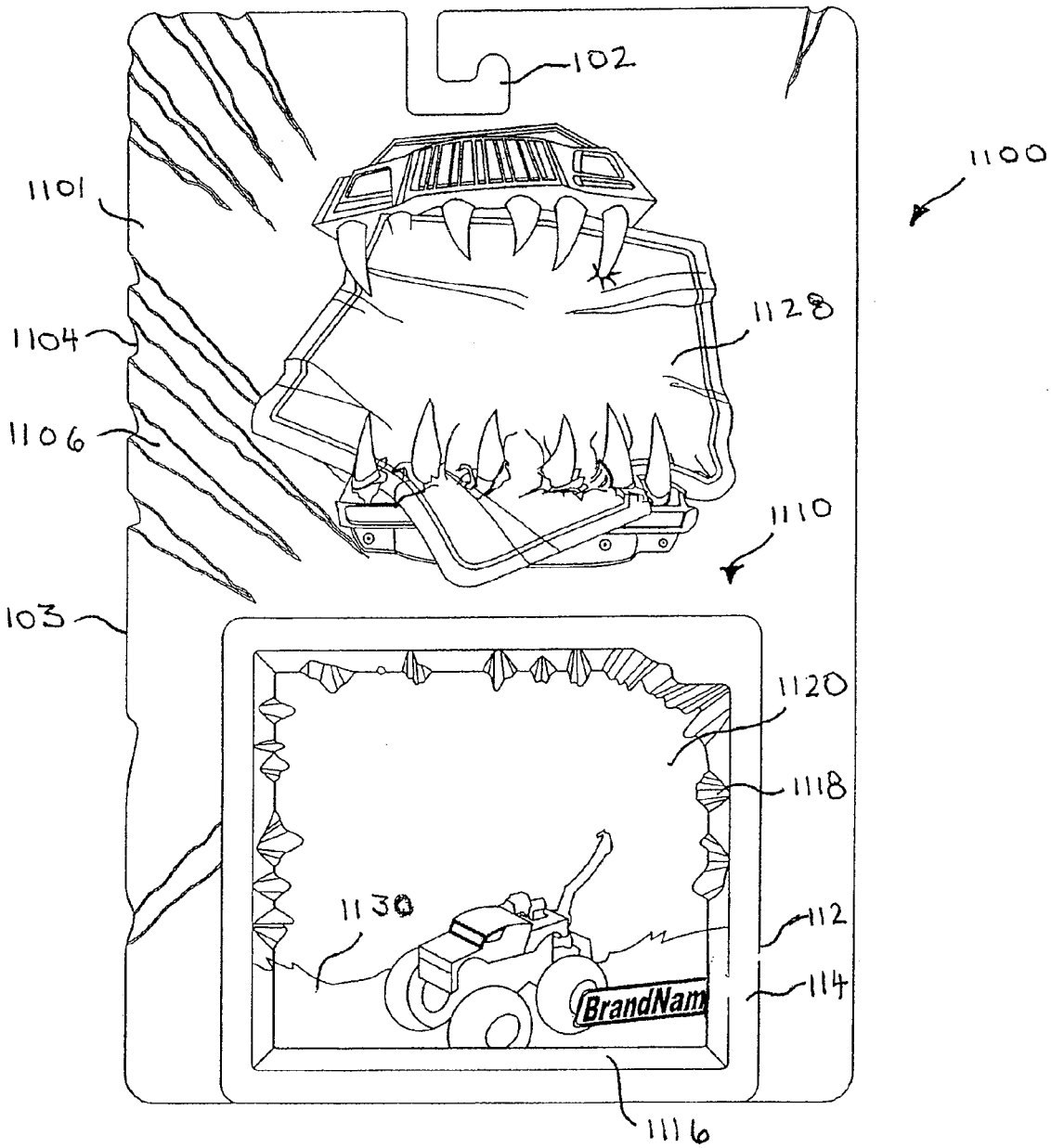
FIGS. 11-12 show a sixth example packaging.
Figure 12:
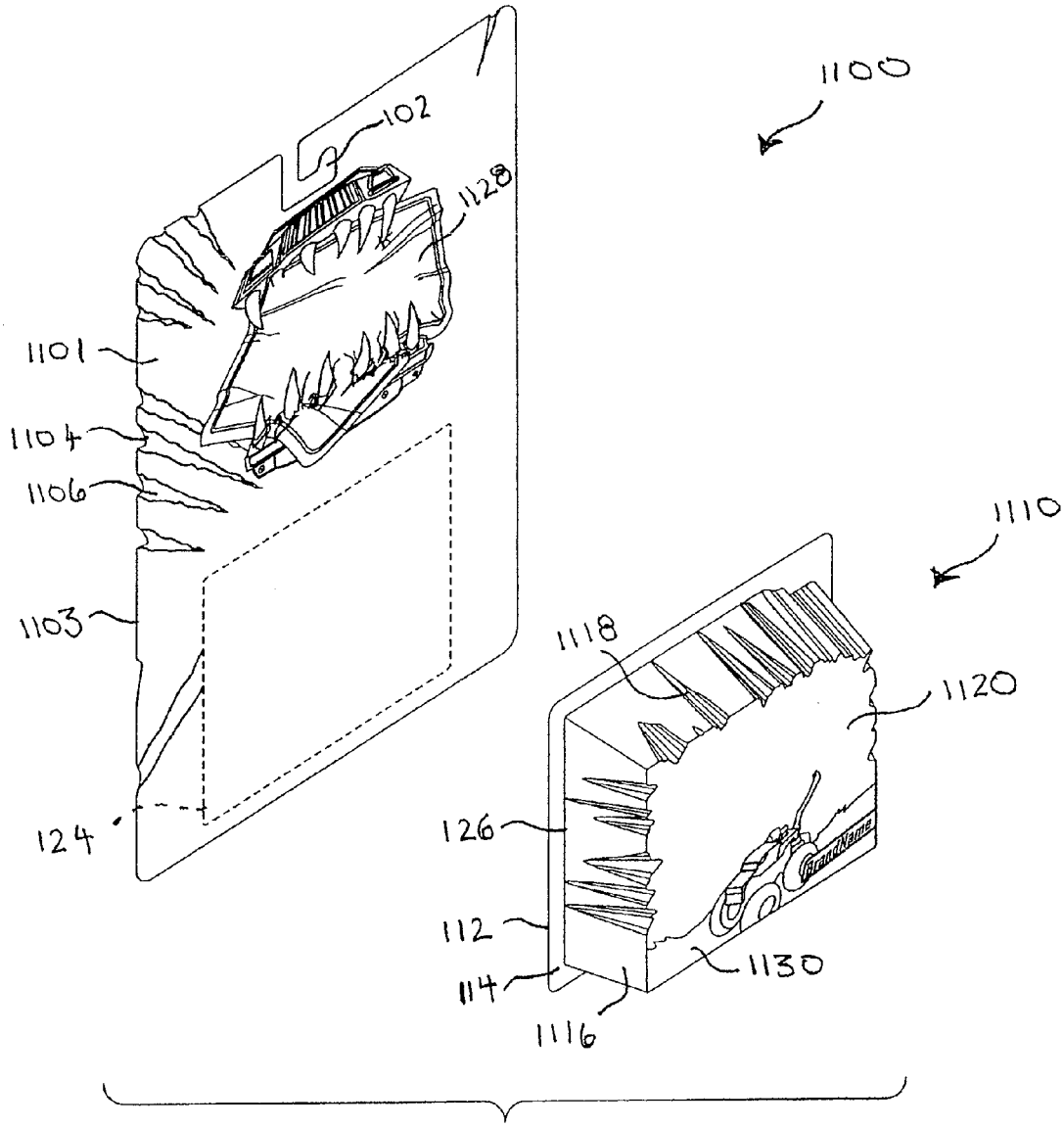

Even another embodiment of the packaging 1100 is shown in FIGS. 11-12. In this embodiment, the product (not shown) being displayed may be a toy monster truck or toy race car that has animal-like qualities such as animal print exterior details and/or jaws on the front grill, for example. The packaging 1100 may include a backer board 1101 and a front panel 1110. The backer board 1101 may be graphically distressed with drawings of claw marks 1106 where the claw marks 1106 may be a different color or shading than the majority of the backer board 1101. The outer surface 1120 and/or the side surface 1116 of the front panel may include a plurality of physically distressed elements 1118 that may or may not extend to the backer board 1101. Other visual elements may be included in the packaging 1100. For example, the outer surface 1120 of the front panel 1110 exhibits a cardboard cutout 1130 relating to the product (not shown) displayed within the front panel. For example, the cardboard cutout may show a graphic of the product on rough terrain similar to the distressing of the front panel. Other graphics, such as a logo or product name 1128, may be displayed on the packaging 1100.

In this embodiment, the backer board 1101 includes graphically distressed drawings of claw marks 1106 that extend from an edge distress 1104. The edge distress 1104 includes jagged notches at the edge 1103 of the backer board 1101 that imitate the beginning of a clawing motion, for example. Graphically distressed drawings of claw marks 1106 extend from the edge distress 1104 across the backer board 1101. The edge distress 1104 and the drawings of the claw marks 1106 are spatially arranged to form an extended visual element and simulate the effects of a clawing motion.

Continuing with this example, the front panel 1110 may include physically distressed elements 1118. In this embodiment, the physically distressed elements 1118 may be ridges that extend along the side surface 1116. The physically distressed elements 1118 vary in size, shape, and depth. Further, the physically distressed elements 1118 may be simulating the effects of rocky terrain, for example. In this example, the physically distressed elements 1118 are not spatially coordinated with the graphically distressed drawing of claw marks 1106 on the backer board 1101, although they could be in another embodiment. Here, the physically distressed elements 1118 have a different theme than the graphically distressed elements. Specifically, the physically distressed elements 1118 may be simulating the effects of rocky terrain such that a monster truck might experience, for example. Further, the graphically distressed drawings of claw marks 1106 may be simulating the effects of the product, for example a toy with animal like characteristics, clawing the packaging 1100. Although the theme of the physically distressed elements 1118, the ridged effect of rocky terrain for example, are different from the theme of the graphically distressed claw marks 1106, for example, the themes are both related to the product (not shown).

In an alternate embodiment, the themes of the physically distressed elements 1118 and the graphically distressed elements may be the same. For example, the physically distressed elements 1118 simulating the effects of rocky terrain could be extended across the backer board 1101 in a graphically distressed element, such as drawings of rocks in motion for example, to form an extended visual element.

Figure 4:
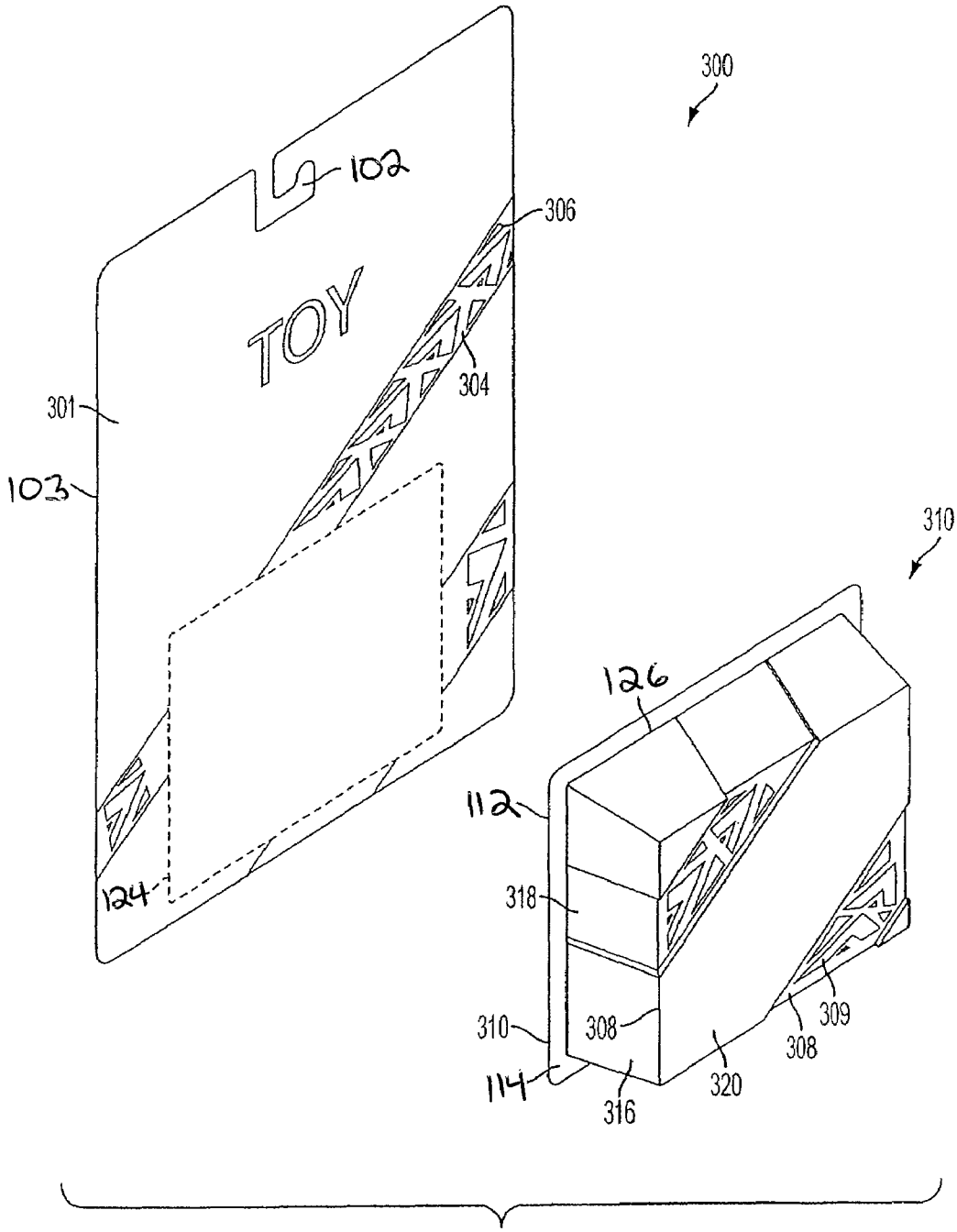

It will be appreciated that the configurations and embodiments disclosed herein are exemplary in nature, and that these specific embodiments are not to be considered in a limiting sense, because numerous variations are possible. The components, shapes, colors, etc. described herein are non-limiting examples and it should be understood that each of these features may be changed. For example, a line of products, such as a line of various different types of toy vehicles, may be marketed where a plurality of different packages use different types of extended visual element. In other words, one toy vehicle may have claw mark distress as shown in FIGS. 1-2, while another toy vehicle may have track mark distress as shown in FIGS. 3-4, yet the products may be marketed together and/or displayed together. Further, a plurality of alternative types of distress may be applied to a plurality of co-marketed products, so that when displayed a plurality of distressed packages are visible to a purchaser, thereby enhancing visual impact of a line of related toy products.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A package for a product, comprising:

an extended visual element having a first visual element section and a second visual element section, the first visual element section including a shape distressed region and the second visual element section including a graphically distressed region;

a first packaging portion including a backer board; and a second packaging portion including a clear front panel, wherein the extended visual element traverses across and extends into a non-edge of at least one of the first and second packaging portions.

2. The package of claim 1, wherein the first visual element section is contiguous with the second visual element section.

3. The package of claim 1, wherein the extended visual element simulates distress caused by a common distressing event.

4. The package of claim 1, wherein the extended visual element comprises claw marks and the product comprises a toy vehicle configured to transform into an animal.

5. The package of claim 1, wherein the extended visual element comprises tire tracks and the product comprises a toy vehicle.

6. The package of claim 1, wherein the extended visual element comprises burn marks and the product comprises a toy vehicle.

7. The package of claim 1, further comprising edge distress related to the graphically distressed region.

8. The package of claim 7, wherein the edge distress is spatially coupled to the graphically distressed region.

9. A system, comprising:

a toy product;

packaging for holding and/or displaying the product, the packaging having at least a first packaging portion and a second packaging portion; and an extended visual element having a first visual element section and a second visual element section, the first visual element section including a shape distressed region and the second visual element section including a graphically distressed region, the first visual element section extended over at least a part of the first packaging portion and the second visual element section extended over at least a part of the second packaging portion, where the first and second visual element sections are spatially aligned to generate an appearance that the packaging has been distressed by a feature of the toy product.

10. The system of claim 9, wherein the toy product comprises a figure, and where the first packaging portion comprises a plastic panel and the second packaging portion comprises a backer board, the plastic panel shaped for holding the toy product, the first visual element section and the second visual element section being spatially aligned and adjacent one another, and the extended visual element appearing as distress caused by a common distressing event.

11. The system of claim 9, wherein the toy product comprises a scale vehicle, and where the first packaging portion comprises a plastic panel and the second packaging portion comprises a backer board, the plastic panel shaped for holding the toy product the first visual element section and the second visual element section being spatially aligned and adjacent one another, and the extended visual element appearing as distress caused by a common distressing event.

12. The system of claim 9, further comprising:

a second toy product;

a second packaging for holding and/or displaying the second product, the second packaging having at least a first packaging portion and a second packaging portion; and a second extended visual element having a first visual element section and a second visual element section, the first visual element section including a shape distressed region and the second visual element section including a graphically distressed region, the first visual element section extended over at least a part of the first packaging portion and the second visual element section extended over at least a part of the second packaging portion, where the first and second visual element sections are spatially aligned to generate an appearance that the second packaging has been distressed by a feature of the second toy product, the first extended visual element different from the second extended visual element.

13. A package for a product, comprising:

an extended visual element having a first visual element section, a second visual element section, and a third visual element section, each of the first and third visual element sections including a shape distressed region and the second visual element section including a graphically distressed region;

a blister panel including the first visual element section; and a backer board including the second visual element section and the third visual element section, wherein the third visual element section includes an edge counter distress at an edge of the backer board, the backer board coupled to the blister panel to retain the product.

14. The package of claim 13, where the third visual element section is spatially adjacent the second visual element section.

15. The package of claim 13, wherein the first visual element section comprises a shape disruption to a surface of the blister panel.

16. The package of claim 15, wherein the shape disruption comprises indentations to an outer surface of the blister panel.

17. The package of claim 13, wherein the first and second visual element sections are spatially aligned and adjacent one another.

18. A package for a product, comprising:

a first packaging portion including a backer board;

a second packaging portion including a clear front panel; and an extended visual element having a first visual element section and a second visual element section, the first visual element section including a shape distressed region and the second visual element section including a graphically distressed region, wherein the shape distressed region includes a distressed edge extending from an edge of the backer board and into a non-edge thereof.

19. The package of claim 18, wherein the product is a toy monster truck having animal features, and said extended visual element is aligned to generate an appearance that the package has been distressed by the animal features.

20. The package of claim 18, wherein the first and second packaging portions form a blister pack containing the product.

21. The package of claim 18, wherein the extended visual element includes distress appearing to be caused by a claw mark across the package.

* * * * *

UNITED STATES PATENT AND TRADEMARK OFFICE

CERTIFICATE OF CORRECTION

PATENT NO. : 7,614,498 B2
APPLICATION NO. : 11/429130
DATED : November 10, 2009
INVENTOR(S) : Bill O'Keefe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 659 days.

Signed and Sealed this

Nineteenth Day of October, 2010

David J. Kappos

David J. Kappos
*Director of the United States Patent and Trademark Office*